US011069497B2

(12) United States Patent
Takeda

(10) Patent No.: US 11,069,497 B2
(45) Date of Patent: Jul. 20, 2021

(54) TEMPERATURE SWITCH AND INSULATING CASE FOR TEMPERATURE SWITCH

(71) Applicant: Uchiya Thermostat Co., Ltd., Saitama (JP)

(72) Inventor: Hideaki Takeda, Saitama (JP)

(73) Assignee: Uchiya Thermostat Co., Ltd., Saitama (JP)

( * ) Notice: Subject to any disclaimer, the term of this patent is extended or adjusted under 35 U.S.C. 154(b) by 428 days.

(21) Appl. No.: 16/070,977

(22) PCT Filed: Nov. 9, 2016

(86) PCT No.: PCT/JP2016/083299
§ 371 (c)(1),
(2) Date: Jul. 18, 2018

(87) PCT Pub. No.: WO2017/130518
PCT Pub. Date: Aug. 3, 2017

(65) Prior Publication Data

US 2020/0118777 A1 Apr. 16, 2020

(30) Foreign Application Priority Data

Jan. 26, 2016 (JP) ..... JP2016-012398

(51) Int. Cl.
*H01H 37/04* (2006.01)
*H01H 37/52* (2006.01)
*H01H 37/54* (2006.01)

(52) U.S. Cl.
CPC ..... *H01H 37/04* (2013.01); *H01H 37/52* (2013.01); *H01H 37/5427* (2013.01); *H01H 2037/5481* (2013.01)

(58) Field of Classification Search
CPC ..... H01H 37/04; H01H 37/52; H01H 2037/5481; H01H 37/5427; H01H 9/02;
(Continued)

(56) References Cited

U.S. PATENT DOCUMENTS 4,894,634 A * 1/1990 Nezuka ..... H01H 37/5418 337/343
5,689,173 A * 11/1997 Oosaki ..... H01M 2/348 429/7

(Continued)

FOREIGN PATENT DOCUMENTS

CN 203631419 U 6/2014
JP 61136437 8/1986

(Continued)

OTHER PUBLICATIONS

Iwasaki; Takaaki, "Case fixed with Insulated Condctorand Fixing Method for Insulated Conductor to Case", Nov. 30, 1999, Keyence Co. LTD, Entire Document (Translation of JPH11329182)(of record, cited in IDS, including Original Copy). (Year: 1999).*

(Continued)

*Primary Examiner* — Stephen S Sul
(74) *Attorney, Agent, or Firm* — Schwegman Lundberg & Woessner, P.A.

(57) ABSTRACT

A temperature switch includes a temperature detection unit configured to detect a temperature so as to move a movable contact to a position that is in contact with a fixed contact and to a position that is separated from the fixed contact, a first lead wire that is connected to the fixed contact and that includes a covering member, a second lead wire that is connected to the movable contact and that includes a covering member, and a first-insulation-case member and a second-insulation-case member each of which includes a first-lead-wire concave portion and a second-lead-wire concave portion, and which are fit into each other so as to form accommodation space S that accommodates the temperature detection unit, the movable contact, and the fixed contact, where first-lead-wire concave portion accepts insertion of the covering member of the first lead wire and the second- (Continued)

lead-wire concave portion accepts insertion of the covering member of the second lead wire.

4 Claims, 8 Drawing Sheets

(58) Field of Classification Search
CPC . H01H 85/165; H01H 85/175; H01H 85/2045
USPC ..... 337/14, 16, 112, 380
See application file for complete search history.

(56) References Cited

U.S. PATENT DOCUMENTS 5,757,262 A * 5/1998 Takeda ..... H01H 37/5418 337/333
6,184,768 B1 * 2/2001 Hsu ..... H01H 61/02 337/318
6,300,860 B1 * 10/2001 Hofsass ..... H01H 1/504 337/100
6,396,381 B1 * 5/2002 Takeda ..... H01H 1/504 337/342
7,330,097 B2 * 2/2008 Takeda ..... H01H 1/504 337/102
9,159,985 B2 * 10/2015 Nakanishi ..... H01M 2/348
9,831,056 B2 * 11/2017 Mochizuki ..... H01H 83/20
2002/0145502 A1 * 10/2002 Hofsass ..... H01H 37/5427 337/343
2012/0299690 A1 * 11/2012 Nakanishi ..... H01M 2/348 337/38
2017/0062161 A1 * 3/2017 Takeda ..... H01H 37/52

FOREIGN PATENT DOCUMENTS

JP 11329182 A 11/1999
JP 2001035330 A 2/2001
JP 2007242351 A 9/2007

OTHER PUBLICATIONS

Jiang; Jinbo, "Novel Heat Protector Packing Structure", Jun. 4, 2014, Dongguan Topro Electrical Technology Co LTD, Entire Document (Translation of CN 203631419)(of record, cited in IDS, including Original Copy). (Year: 2014).*
"Chinese Application Serial No. 201680079244.0, Office Action dated Sep. 20, 2019", w English Translation, 24 pgs.
"Chinese Application Serial No. 201680079244.0 Office Action dated Mar. 21, 2019", w/English Translation, 26 pgs.
"International Application No. PCT/JP2016/083299, Article 19 Amendments filed Mar. 22, 2017", w/ Accompanying letter, (dated Mar. 22, 2017), 10 pgs.
"International Application No. PCT/JP2016/083299, International Search Report dated Feb. 14, 2017", w/ English Translation, (dated Feb. 14, 2017), 4 pgs.
"International Application No. PCT/JP2016/083299, Written Opinion dated Feb. 14, 2017", (dated Feb. 14, 2017), 4 pgs.

* cited by examiner

TEMPERATURE SWITCH AND INSULATING CASE FOR TEMPERATURE SWITCH

PRIORITY APPLICATIONS

This application is a U.S. National Stage Filing under 35 U.S.C. 371 from International Application No. PCT/JP2016/083299, filed on Nov. 9, 2016, and published as WO2017/130518 on Aug. 3, 2017, which claims the benefit of priority to Japanese Application No. 2016-012398, filed on Jan. 26, 2016; the benefit of priority of each of which is hereby claimed herein, and which applications and publication are hereby incorporated herein by reference in their entirety.

FIELD

The present invention is related to a temperature switch that opens and closes an electric circuit and to a temperature-switch insulation case used for this type of temperature switch.

BACKGROUND

Temperature switches have conventionally been known in which the insulation case is filled with a filling material such as a hardening resin so as to mechanically hold a lead wire that is connected to a terminal unit accommodated in the insulation case (see Patent Document 1 for example).

Temperature switches are also known in which the upper and lower insulation-case members are fit into each other although they just sandwich a plate-like terminal instead of holding a lead wire (see Patent Document 2 for example).

PRIOR ART DOCUMENT

Patent Document

[Patent Document 1] Japanese Laid-open Patent Publication No. 2001-35330

[Patent Document 2] Japanese Laid-open Patent Publication No. 2007-242351

SUMMARY

Technical Problem

Incidentally, the conventional filling-material filling process has two purposes. One is insulation, and the other is the reinforcement of the portion at which the lead wire and the terminal are connected. The insulation is set depending upon the physical distance between the internal live part and the external environment, and requires a dimension that will not cause a problem even when the boundary surface between the lead wire and the filling material peels. For the reinforcement, a hardening resin is advantageous in protecting the above internal connection portion from an external force because the internal connection portion uses a core wire (lead wire).

Also, the covering member of a lead wire is required to be able to respond to bending, and is made of a resin that is relatively flexible. Meanwhile, a filling material used for the above filling is made of a resin that is in a liquid state during the filling and hardens in response to a chemical reaction. This may lead to a problem on the boundary surface between the covering member of a lead wire, which is relatively soft, and a filling material that is relatively hard. For example, there is a problem in which strongly bending a lead wire makes an end portion of the filling material damage the covering member of the lead wire.

Also, the covering member of a lead wire and a filling material tend to fail to be adhered to each other with a high strength, often leading to a situation in which strongly bending the lead wire causes the covering member of the lead wire and the filling material to peel from each other on the boundary surface. This also leads to a problem in which the way of providing a lead wire has to be limited such as for example limiting the range within which the lead wire can bend in order to prevent the peeling.

Further, a filling material is in a liquid state during the filling, leading to problems in which the filling operations require expertise, the hardening of the filling material requires a thermal treatment, and stains are made by a spilt filling material. Note that a filling material being in a liquid state during the filling results in elevation of the center portion of an end portion because of the surface tension, damaging the covering member of the lead wire more often. Further, when the hardening of the filling material requires a heat treatment, the insulation case will also be limited for its heat resistance.

It is an object of the present invention to provide a temperature switch and a temperature-switch insulation case that can prevent damage to the covering member of a lead wire and can surely hold the lead wire, through a simple assembly operation.

Solution to Problem

According to an aspect, a temperature switch includes a temperature detection unit configured to detect a temperature so as to move a movable contact to a position that is in contact with a fixed contact and to a position that is separated from the fixed contact, a first lead wire that is connected to the fixed contact and that includes a covering member, a second lead wire that is connected to the movable contact and that includes a covering member, and a first-insulation-case member and a second-insulation-case member each of which includes a first-lead-wire concave portion and a second-lead-wire concave portion, and which are fit into each other so as to form an accommodation space that accommodates the temperature detection unit, the movable contact, and the fixed contact, where the first-lead-wire concave portion accepts insertion of the covering member of the first lead wire and the second-lead-wire concave portion accepts insertion of the covering member of the second lead wire.

According to another aspect, a temperature-switch insulation case arranged in a temperature switch that includes a temperature detection unit configured to detect a temperature so as to move a movable contact to a position that is in contact with a fixed contact and to a position that is separated from the fixed contact includes a first-insulation-case member and a second-insulation-case member each of which includes a first-lead-wire concave portion and a second-lead-wire concave portion, and which are fit into each other so as to form an accommodation space that accommodates the temperature detection unit, the movable contact, and the fixed contact, where the first-lead-wire concave portion accepts insertion of a covering member of a first lead wire that is connected to the fixed contact and that includes the covering member and the second-lead-wire concave portion accepts insertion of a covering member of a second lead wire that is connected to the movable contact and that includes the covering member.

Advantageous Effects of Invention

The present invention can prevent damage to the covering member of a lead wire and can surely hold the lead wire, through a simple assembly operation.

DESCRIPTION OF EMBODIMENTS

Figure 1:
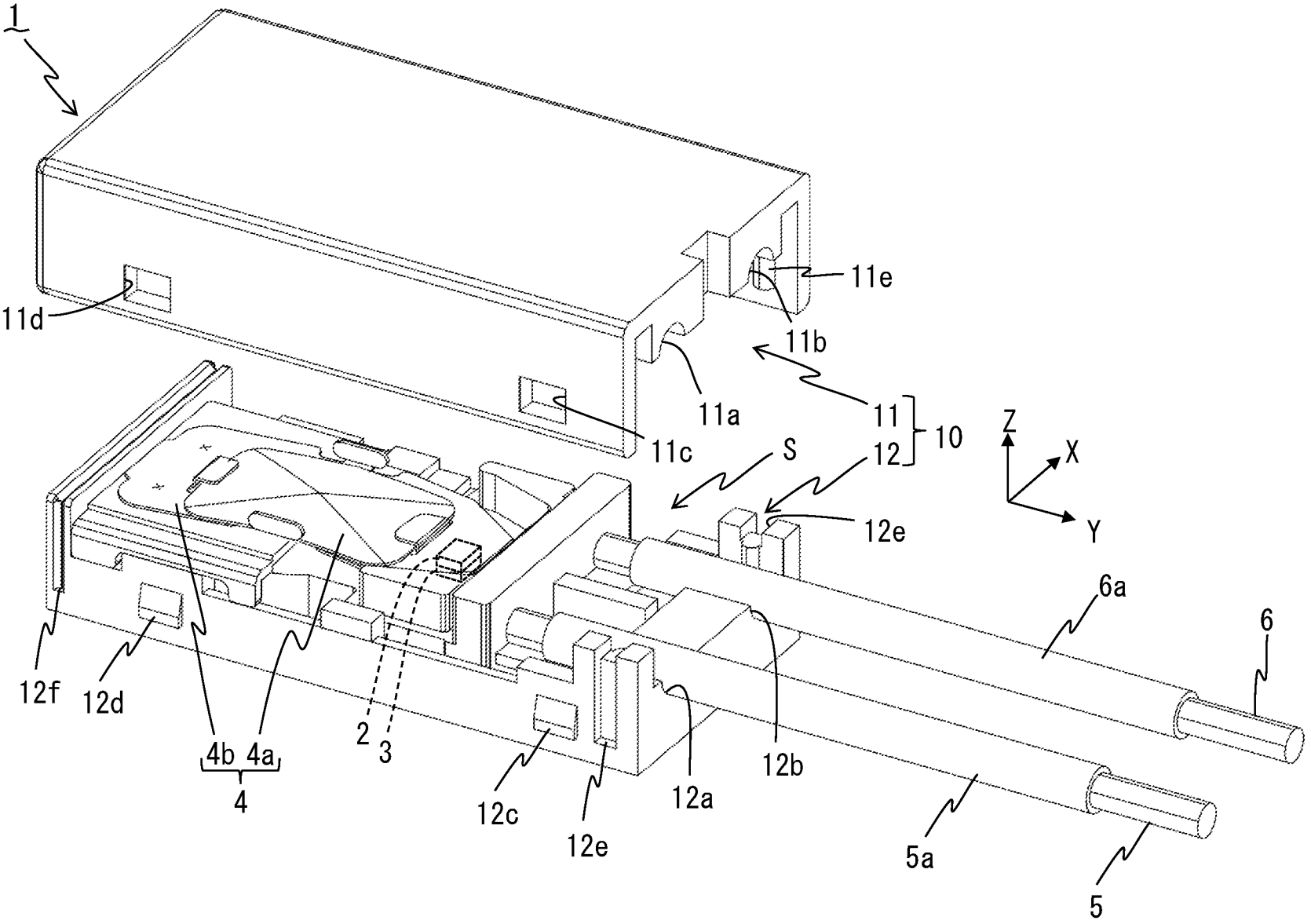
FIG. 1 is an exploded perspective view illustrating a temperature switch according to the first embodiment.

Hereinafter, explanations will be given for the temperature switches and the temperature-switch insulation cases according to the first through sixth embodiments of the present invention by referring to the drawings.

First Embodiment

Figure 2:
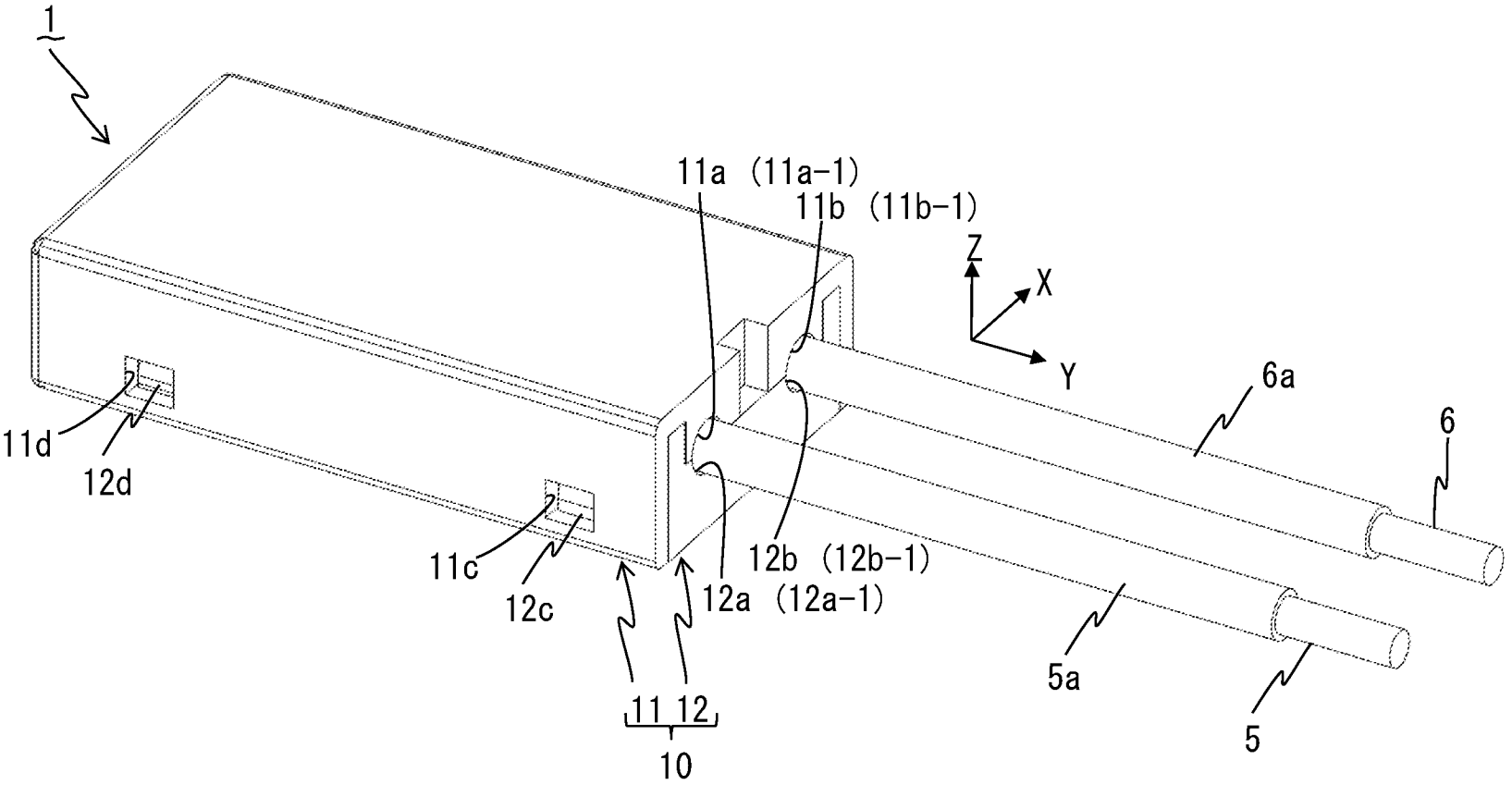
FIG. 2 is a perspective view illustrating the temperature switch according to the first embodiment.

FIG. 1 is an exploded perspective view illustrating a temperature switch 1 according to the first embodiment. FIG. 2 is a perspective view illustrating the temperature switch 1 according to the first embodiment.

Figure 3:
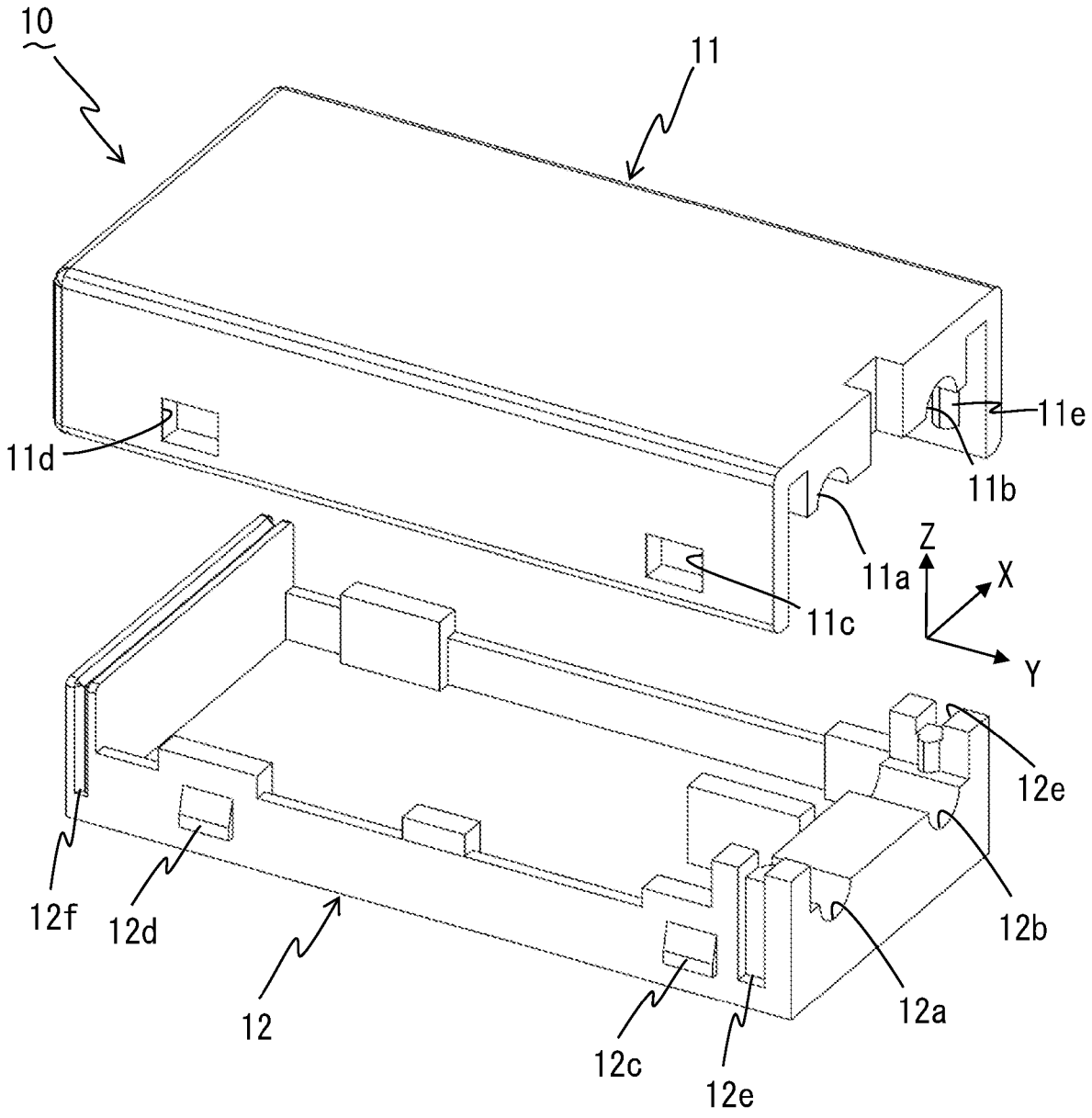
FIG. 3 is an exploded perspective view illustrating a temperature-switch insulation case according to the first embodiment.

FIG. 3 is an exploded perspective view illustrating a temperature-switch insulation case (which will hereinafter be referred to simply as "insulation case") 10 according to the first embodiment. The temperature switch 1 includes a movable contact 2, a fixed contact 3, a temperature detection unit 4, a first lead wire 5, a second lead wire 6, and the insulation case 10. The temperature switch 1 can be used for various purposes, and for example is embedded in an electric device such as an electric motor so as to operate to break the current path in response to overheating or overcurrent in the electric device.

The movable contact 2 is fixed to the bottom face of one end of a movable plate 4*b*, which will be described later, in the longitudinal directions (identical to for example the axial directions (Y directions) of the first and second lead wires 5 and 6, which will be described later), and moves, through an inverted operation of the movable plate 4*b*, to the position that is in contact with the fixed contact 3 (see FIG. 1) and to a position that is separated from the fixed contact 3. The movable contact 2 is electrically connected to the second lead wire 6 via a terminal (not illustrated). The fixed contact 3 is electrically connected to the first lead wire 5 as well via a terminal (not illustrated). Note the above portion at which the terminal and the first and second lead wires 5 and 6 are connected is for example a position different from the temperature detection unit 4. Also, the movable contact 2 and the fixed contact 3 are depicted by the hidden lines (dashed lines) in FIG. 1 because they are behind the movable plate 4*b*. While FIG. 1 illustrates a case in which the first and second lead wires 5 and 6 are collaterally inserted through the same plane of the insulation case 10, a different configuration is also possible including a configuration for example in which the first lead wire 5 is inserted through one of the two opposed faces of the insulation case 10 and the second lead wire 6 is inserted through the other face.

The temperature detection unit 4 includes a bimetal 4*a* and the movable plate 4*b* to detect a temperature, and thereby move the movable contact 2 to the position that is in contact with the fixed contact 3 and to a position that is separated from the fixed contact 3.

The bimetal 4*a* is a thermally actuated element that inverts the bending-back direction by treating the set temperature as a boundary. The movable plate 4*b* supports the bimetal 4*a* while being in surface contact with the bimetal 4*a*, and is elastically deformed by the inversion of the bimetal 4*a* and in accordance with the shape of the bimetal 4*a*. Note that it is desirable that the movable plate 4*b* be a good conductor of electricity in order to form a current path between the movable contact 2 and the second lead wire 6.

In a normal state, the bimetal 4*a* and the movable plate 4*b* have their center portions, which are in the longitudinal directions (Y directions that are identical to the axial directions of the first and second lead wires 5 and 6) as illustrated in FIG. 1, inverted upward to form convex portions, and both sides of the convex portions face downward. In this normal state, the movable contact 2 and the fixed contact 3 are in contact with each other. In other words, the electric contact of the energizing circuit of the electric device is closed so that a current flows through the above current path.

When the ambient temperature exceeds the set temperature, the center portions in the longitudinal directions of the bimetal 4*a* and the movable plate 4*b* are inverted to form downward-facing convex portions, and both sides of the convex portions face upward. This moves the movable contact 2 to a position that is separated from the fixed contact 3. In other words, the electric contact of the energizing circuit of the electric device is opened to break the current path.

Note that the temperature detection unit 4 is not limited to a configuration having the bimetal 4*a* and the movable plate 4*b*, and may employ a different configuration such as for example a configuration of moving a movable contact by the inflation of a gas or a liquid. The first and second lead wires 5 and 6 are flexible, and are at least partially covered by covering members 5*a* and 6*a*. The covering members 5*a* and 6*a* are elastic bodies such as for example silicone rubber, fluorocarbon rubber, or a plastic resin.

The insulation case 10 has the shape of a rectangular parallelepiped having edges that are parallel to the X, Y, or Z direction each of which is orthogonal to the others, and includes a first-insulation-case member 11 and a second-insulation-case member 12 fit into each other to form accommodation space S illustrated in FIG. 1 accommodating the movable contact 2, the fixed contact 3, the temperature detection unit 4, etc. The insulation case 10 uses for example an insulative synthetic resin for its material. In an example, the first-insulation-case member 11, which is above the second-insulation-case member 12, is arranged to cover the second-insulation-case member 12 on the faces on the far side (left side in FIG. 1 and FIG. 3) and the left and right sides (front side and the back side in FIG. 1 and FIG. 3) seen from the near side, i.e. the faces other than the face on the near side (right side in FIG. 1 and FIG. 3), which is the exit side on which the first and second lead wires 5 and 6 exit from the temperature switch 1.

The first-insulation-case member 11 includes a first-lead-wire concave portion 11*a* and a second-lead-wire concave portion 11*b*, and the second-insulation-case member 12 includes a first-lead-wire concave portion 12*a* and a second-lead-wire concave portion 12*b*. The first-insulation-case member 11 further includes two pairs of external-lock openings 11*c* and 11*d*, a pair of near-side convex portions 11*e*, and one far-side convex portion (not illustrated). The second-insulation-case member 12 further includes two pairs of external-lock clicks 12*c* and 12*d*, a pair of near-side grooves 12*e* and 12*e*, and one far-side groove 12*f*.

The first-lead-wire concave portions 11*a* and 12*a* and the second-lead-wire concave portions 11*b* and 12*b* are parallel to the axial directions of the first and second lead wires 5 and 6 (Y directions), and have a semicylindrical shape having radiuses roughly identical to (or, desirably, somewhat greater than) those of the first and second lead wires 5 and 6. It is desirable that the first-lead-wire concave portions 11*a* and 12*a* and the second-lead-wire concave portions 11*b* and 12*b* in the axial directions (Y directions) be long enough to ensure the insulation distance in the insulation case 10.

The first-lead-wire concave portion 11*a*, which is for the first-insulation-case member 11, and the first-lead-wire concave portion 12*a*, which is for the second-insulation-case member 12, are opposed to each other in for example the Z directions, which are vertical directions, and the covering member 5*a* of the first lead wire 5 is inserted between them. The second-lead-wire concave portion 11*b*, which is for the first-insulation-case member 11, and the second-lead-wire concave portion 12*b*, which is for the second-insulation-case member 12, are also opposed to each other in for example the Z directions, which are vertical directions, and the covering member 6*a* of the second lead wire 6 is inserted between them.

For the end portions on the near side in the Y directions (right side in FIG. 2), which is the exit side on which the first and second lead wires 5 and 6 exit from the temperature switch 1, it is desirable as illustrated in FIG. 2 for the first-lead-wire concave portions 11*a* and 12*a* and the second-lead-wire concave portions 11*b* and 12*b* to employ a configuration in which the end portions do not damage the covering members 5*a* and 6*a* of the first and second lead wires 5 and 6 even when the first and second lead wires 5 and 6 bend, such by for example forming chamfered portions 11*a*-1, 12*a*-1, 11*b*-1, and 12*b*-1 all along the circumference of the end portions.

As illustrated in FIG. 1 and FIG. 3, the two pairs of the external-lock openings 11*c* and 11*d* of the first-insulation-case member 11 pierce the first-insulation-case member 11 in the arrangement directions of the first and second lead wires 5 and 6 (X directions), which are the directions orthogonal to the axial directions (Y directions), and are arranged at opposed positions in this arrangement directions (X directions) (in FIG. 1 and FIG. 3, only the front side is illustrated and the back side is blocked). The two pairs of the external-lock clicks 12*c* and 12*d* of the second-insulation-case member 12 project to the outside in the arrangement directions of the first and second lead wires 5 and 6 (X directions) (the side opposite from accommodation space S illustrated in FIG. 1), and are arranged at opposed positions in the arrangement directions (X directions) (in FIG. 1 and FIG. 3, only the front side is illustrated and the back side is blocked). These two pairs of the external-lock openings 11*c* and 11*d* and the two pairs of the external-lock clicks 12*c* and 12*d* are positioned on the faces (both the left and right sides on the front and back sides described above in FIG. 1) on both sides sandwiching accommodation space S illustrated in FIG. 1 in the arrangement directions (X directions) of the first and second lead wires 5 and 6. Insertion of the external-lock clicks 12*c* and 12*d* into the external-lock openings 11*c* and 11*d* makes these members function as at least an example of a pair of first lock mechanisms that lock the first-insulation-case member 11 and the second-insulation-case member 12 together. The first-insulation-case member 11 and the second-insulation-case member 12 are thus locked together, and thereby the first-insulation-case member 11 and the second-insulation-case member 12 are fit into each other. The first lock mechanism is not limited to a configuration having a click such as the external-lock clicks 12*c* and 12*d*, but may employ a different configuration such as for example one using a member for achieving interference-fit. Also, it is better to respectively arrange the external-lock openings 11*c* and 11*d* and the external-lock clicks 12*c* and 12*d* around the four corners of the insulation case 10 in a planar view.

The pair of the near-side convex portions 11*e* of the first-insulation-case member 11 project toward the center side of the insulation case 10 in the arrangement directions of the first and second lead wires 5 and 6 (X directions), and are arranged at opposed positions in this arrangement directions (X directions) (in FIG. 1 and FIG. 3, only the back side is illustrated and the front side is blocked). Also, the pair of the near-side grooves 12*e* and 12*e* of the second-insulation-case member 12 are open toward the outside in the arrangement directions of the first and second lead wires 5 and 6 (X directions), and are arranged at opposed positions in this arrangement directions (X directions). Insertion of the pair of the near-side convex portions 11*e* into the pair of the near-side grooves 12*e* locks or positions the first-insulation-case member 11 and the second-insulation-case member 12.

One far-side groove 12*f* of the second-insulation-case member 12 is open over the upper side (one of the Z directions) and the front and back sides (both of the X directions) in FIG. 1 and FIG. 3, accepts the insertion of a far-side convex portion (not illustrated) formed inside the first-insulation-case member 11, and thereby locks or positions the first-insulation-case member 11 and the second-insulation-case member 12.

The temperature switch 1 according to the first embodiment described above includes the temperature detection unit 4 configured to detect a temperature so as to move the movable contact 2 to a position that is in contact with the fixed contact 3 and to a position that is separated from the fixed contact 3, the first lead wire 5 that is connected to the fixed contact 3 and that includes the covering member 5*a*, the second lead wire 6 that is connected to the movable contact 2 and that includes the covering member 6*a*, the first-insulation-case member 11, and the second-insulation-case member 12. The first-insulation-case member 11 includes the first-lead-wire concave portion 11*a* and the second-lead-wire concave portion 11*b* while the second-insulation-case member 12 includes the first-lead-wire concave portion 12*a* and the second-lead-wire concave portion 12*b*, and the first-insulation-case member 11 and the second-insulation-case member 12 are fit into each other so as to form accommodation space S that accommodates the temperature detection unit 4, the movable contact 2, and the fixed contact 3, where the first-lead-wire concave portions 11*a* and 12*a* accept the insertion of the covering member 5*a* of the first lead wire 5 and the second-lead-wire concave portions 11*b* and 12*b* accept the insertion of the covering member 6*a* of the second lead wire 6.

Thus, fitting the first-insulation-case member 11 and the second-insulation-case member 12 enables the first and second lead wires 5 and 6 to be held with an operation easier than in the conventional configuration that uses a filling material. Further, the first-insulation-case member 11 and the second-insulation-case member 12 are not so likely to peel from the covering members 5*a* and 6*a* of the first and second lead wires 5 and 6 as in the configuration using a filling material, eliminating the necessity to limit, in order to prevent the peeling, the way of the provision such as for example limiting the range within which the lead wires 5 and 6 can bend.

The first embodiment thus makes it possible, through a simple assembly operation, to prevent damage to the covering members 5*a* and 6*a* of the first and second lead wires 5 and 6 and to surely hold the first and second lead wires 5 and 6.

Second Embodiment

Figure 4:
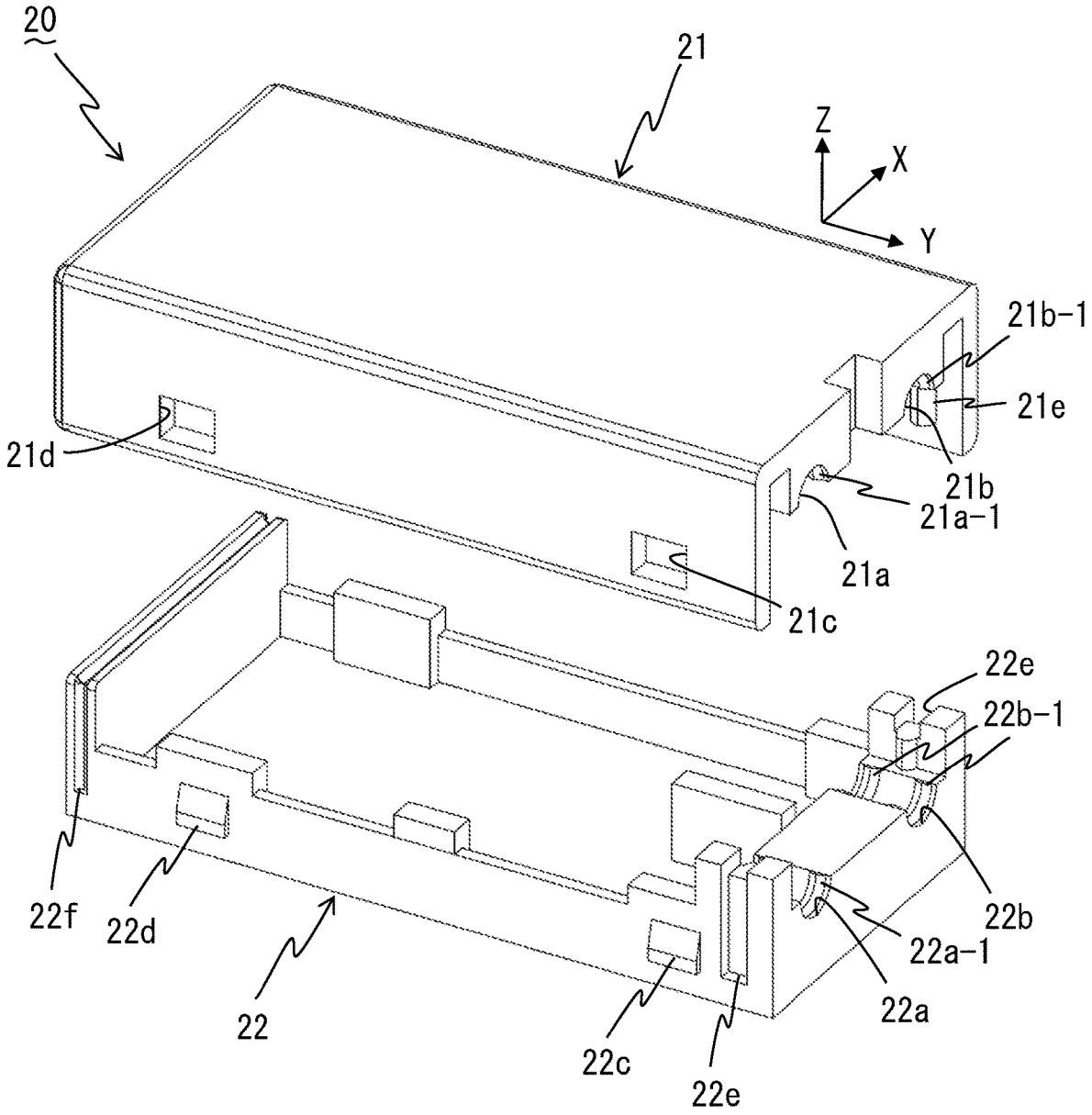
FIG. 4 is an exploded perspective view illustrating a temperature-switch insulation case according to the second embodiment.

FIG. 4 is an exploded perspective view illustrating a temperature-switch insulation case 20 according to the second embodiment. The insulation case 20 according to the second embodiment may be similar to the insulation case 10 according to the first embodiment described above except that first-lead-wire concave portions 21*a* and 22*a* and second-lead-wire concave portions 21*b* and 22*b* of a first-insulation-case member 21 and a second-insulation-case member 22 include a plurality of ribs 21*a*-1, 22*a*-1, 21*b*-1, and 22*b*-1 formed on them. Accordingly, constituents in FIG. 4 that are similar to those denoted by the numbers between 10 and 19 in FIG. 3 are denoted by the numbers between 20 and 29 in such a manner that the constituents similar in FIG. 3 and FIG. 4 have the same ones place digits, and their explanations will be omitted.

On each of the first-lead-wire concave portions 21*a* and 22*a* and the second-lead-wire concave portions 21*b* and 22*b*, a plurality of ribs 21*a*-1, 22*a*-1, 21*b*-1, and 22*b*-1 are formed that project at positions apart in the axial directions (Y directions) of the first and second lead wires 5 and 6. While two ribs exist for each of the numerals (21*a*-1, 22*a*-1, 21 *b*-1, and 22*b*-1) in the example illustrated in FIG. 4, the two ribs (the ribs 22*b*-1) are illustrated only for the second-lead-wire concave portion 22*b* of the second-insulation-case member 22, and only one each of the ribs 21*a*-1, 21*b*-1, and 22*a*-1 is illustrated for the first-lead-wire concave portion 21*a* the second-lead-wire concave portion 21*b* of the first-insulation-case member 21 and the first-lead-wire concave portion 22*a* of the second-insulation-case member 22 because the other each of them is behind other members.

The plurality of ribs 21*a*-1 of the first-lead-wire concave portion 21*a* of the first-insulation-case member 21 and the plurality of ribs 22*a*-1 of the first-lead-wire concave portion 22*a* of the second-insulation-case member 22 come into contact with each other so as to tighten the covering member 5*a* of the first lead wire 5 illustrated in FIG. 1 and FIG. 2 all along the circumference of the covering member 5*a*.

However, while it is desirable that the plurality of the ribs 21*b*-1 of the second-lead-wire concave portion 21*b* of the first-insulation-case member 21 and the plurality of ribs 22*b*-1 of the second-lead-wire concave portion 22*b* of the second-insulation-case member 22 come into contact with each other so as to tighten the covering member 6*a* of the second lead wire 6 illustrated in FIG. 1 and FIG. 2 all along the circumference of the covering member 6*a*, a configuration is also possible in which the ribs 21*a*-1 and 22*a*-1 of the first-lead-wire concave portions 21*a* and 22*a* do not come into contact with each other, the ribs 21*b*-1 and 22*b*-1 of the second-lead-wire concave portions 21*b* and 22*b* do not come into contact with each other, and the covering members 5*a* and 6*a* of the first and second lead wires 5 and 6 are not tightened all along the circumference of them at the same locations. A configuration is also possible in which each of the first-lead-wire concave portions 21*a* and 22*a* and the second-lead-wire concave portions 21*b* and 22*b* includes one rib instead of the plurality of ribs 21*a*-1, 22*a*-1, 21*b*-1, and 22*b*-1 that are apart in the axial directions (Y directions).

The second embodiment can achieve an effect that the first and second lead wires 5 and 6 can be held more surely, in addition to the effects achieved by the above first embodiment.

Third Embodiment

Figure 5:
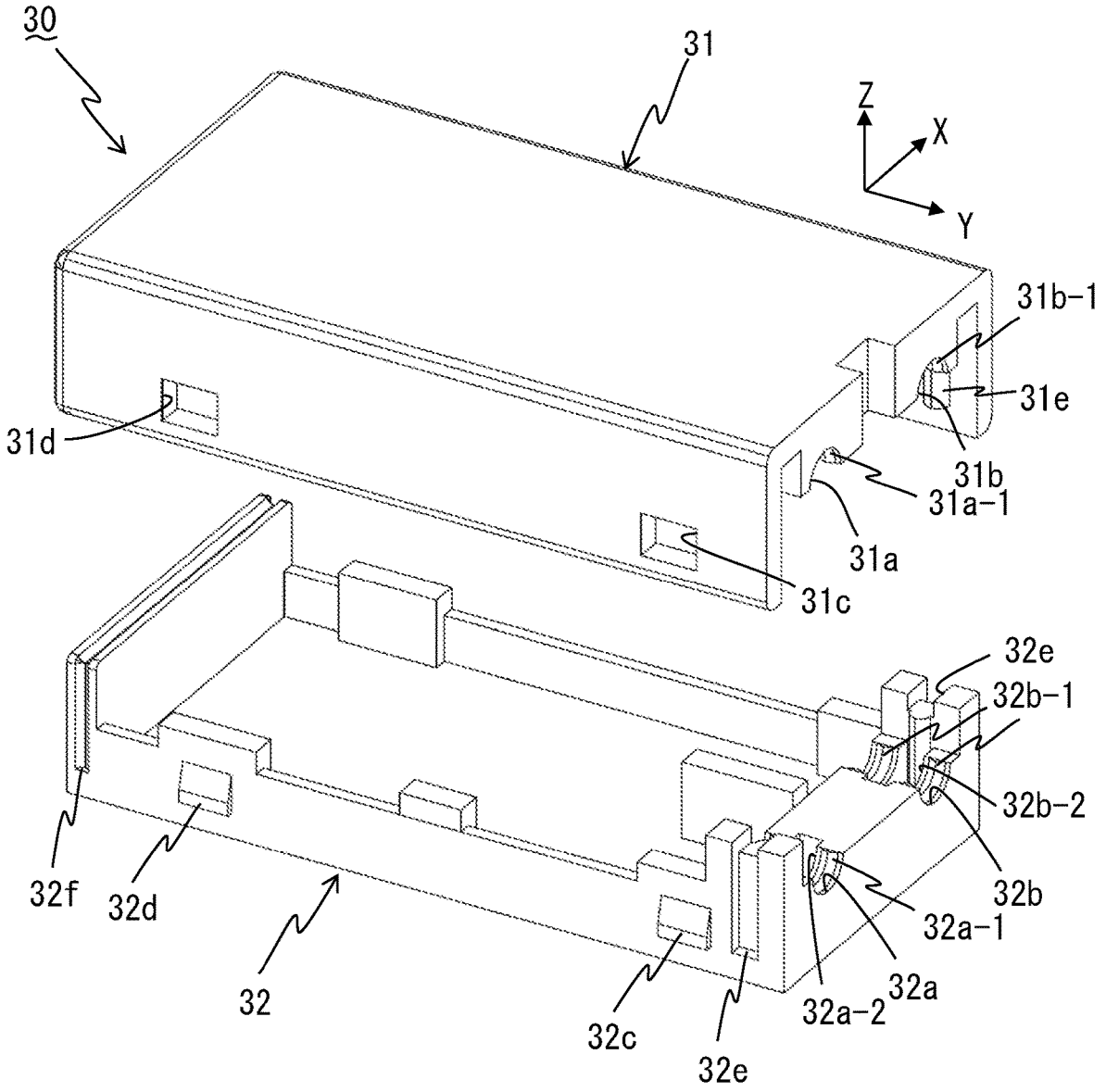
FIG. 5 is an exploded perspective view illustrating a temperature-switch insulation case according to the third embodiment.

FIG. 5 is an exploded perspective view illustrating a temperature-switch insulation case 30 according to the third embodiment. The insulation case 30 according to the third embodiment may be similar to the insulation cases 10 and 20 according to the first and second embodiments above except that first-lead-wire concave portions 31*a* and 32*a* and second-lead-wire concave portions 31*b* and 32*b* of at least one (or both desirably) of a first-insulation-case member 31 and a second-insulation-case member 32 include indentations 32*a*-2 and 32*b*-2 at positions between the plurality of ribs (the indentation of the first-insulation-case member 31 is not illustrated because it is behind another member). Accordingly, constituents in FIG. 5 that are similar to those denoted by the numbers between 20 and 29 in FIG. 4 are denoted by the numbers between 30 and 39 in such a manner that the constituents similar in FIG. 4 and FIG. 5 have the same ones place digits, and their explanations will be omitted.

It is desirable that the indentations 32*a*-2 and 32*b*-2 be provided for example all along the circumference of the covering members 5*a* and 6*a* of the first and second lead wires 5 and 6 illustrated in FIG. 1 and FIG. 2. According to the third embodiment, the indentations 32*a*-2 and 32*b*-2 positioned between a plurality of ribs 31*a*-1, 32*a*-1, 31*b*-1, and 32*b*-1 accommodate the covering members 5*a* and 6*a* of the first and second lead wires 5 and 6 that have been elastically deformed by being tightened by the plurality of ribs 31*a*-1,32*a*-1, 31*b*-1, and 32*b*-1, and thereby spaces are ensured to which the covering members 5*a* and 6*a* of the first and second lead wires 5 and 6 that have been elastically deformed are relieved. This can achieve an effect that the first and second lead wires 5 and 6 can be held further surely, in addition to the effects of the first and second embodiments.

Fourth Embodiment

Figure 6:
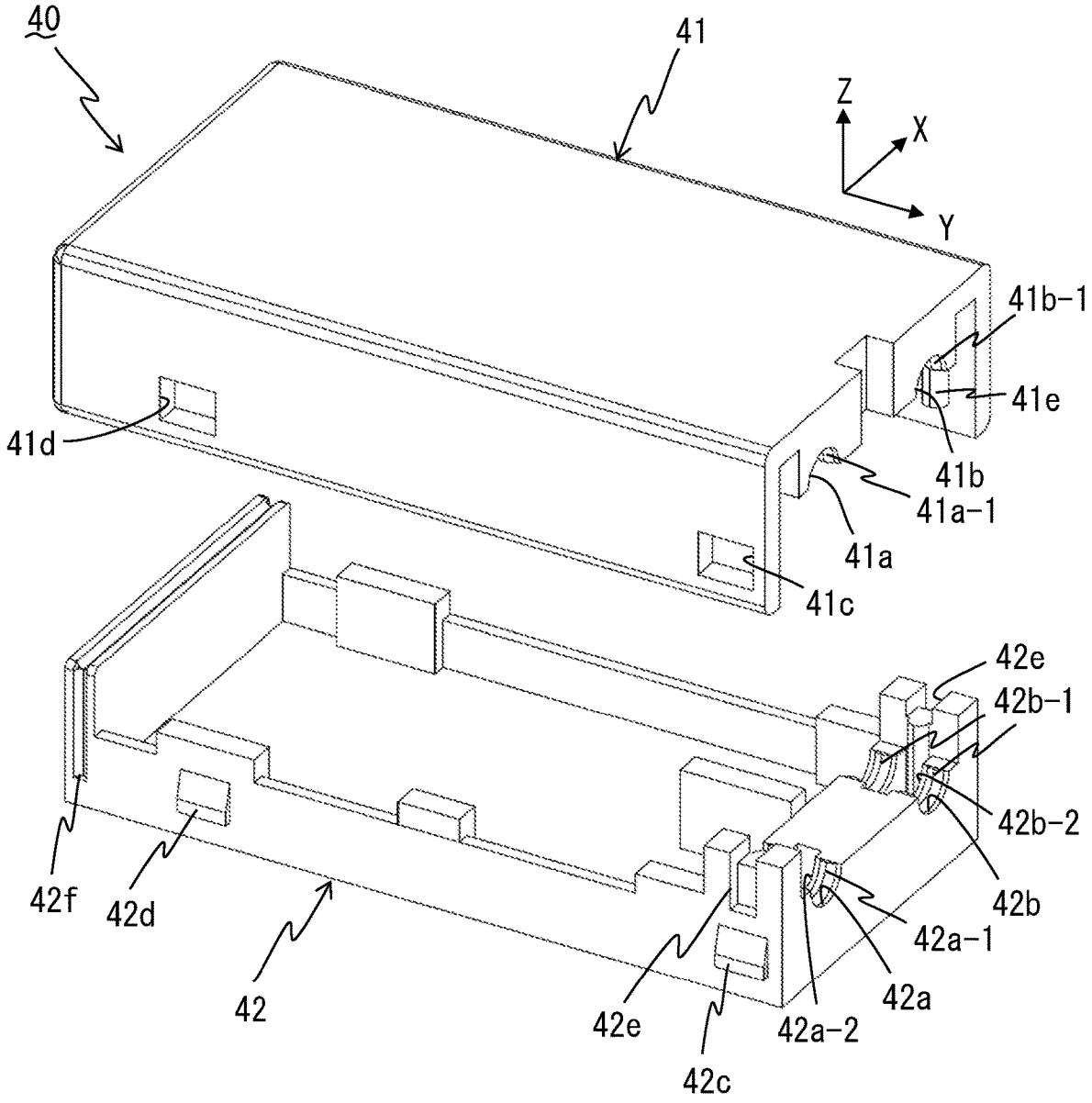
FIG. 6 is an exploded perspective view illustrating a temperature-switch insulation case according to the fourth embodiment.

FIG. 6 is an exploded perspective view illustrating a temperature-switch insulation case 40 according to the fourth embodiment. In the insulation case 40 according to the fourth embodiment, a pair of external-lock openings 41*c*, which is one of two pairs of external-lock openings 41*c* and 41*d*, and a pair of external-lock clicks 42*c*, which is one of two pairs of external-lock clicks 42*c* and 42*d* of the second-insulation-case member 42, intersect a plane (X-Z plane)

that contains the midpoints of the first-lead-wire concave portions 41*a* and 42*a* and the second-lead-wire concave portions 41*b* and 42*b* in the axial directions (Y directions) and that is orthogonal to the axial directions (Y directions), the first-lead-wire concave portions 41*a* and 42*a* and the second-lead-wire concave portions 41*b* and 42*b* being parallel to the axial directions (Y directions) of the first and second lead wires 5 and 6 illustrated in FIG. 1 and FIG. 2. Except this, the insulation case 40 according to the fourth embodiment may be similar to the insulation cases 10, 20, and 30 according to the first through third embodiments. Accordingly, constituents in FIG. 6 that are similar to those denoted by the numbers between 30 and 39 in FIG. 5 are denoted by the numbers between 40 and 49 in such a manner that the constituents similar in FIG. 5 and FIG. 6 have the same ones place digits, and their explanations will be omitted.

A near-side convex portion 41*e* of the first-insulation-case member 41 and a near-side groove 42*e* of the second-insulation-case member 42 are shorter, in the downward direction (Z direction) than a near-side convex portion 31*e* and a near-side groove 32*e* illustrated in FIG. 5 (third embodiment) so that they do not cause interference with a pair of external-lock openings 41*c* and a pair of external-lock clicks 42*c*.

The fourth embodiment can achieve, in addition to the effects of the first through third embodiments, an effect that the balance (balance of stresses) of repelling forces generated by the compression of the covering members 5*a* and 6*a* of the first and second lead wires 5 and 6 can be adjusted by locking the first-insulation-case member 41 and the second-insulation-case member 42 near the portions in which these repelling forces are generated.

Fifth Embodiment

Figure 7:
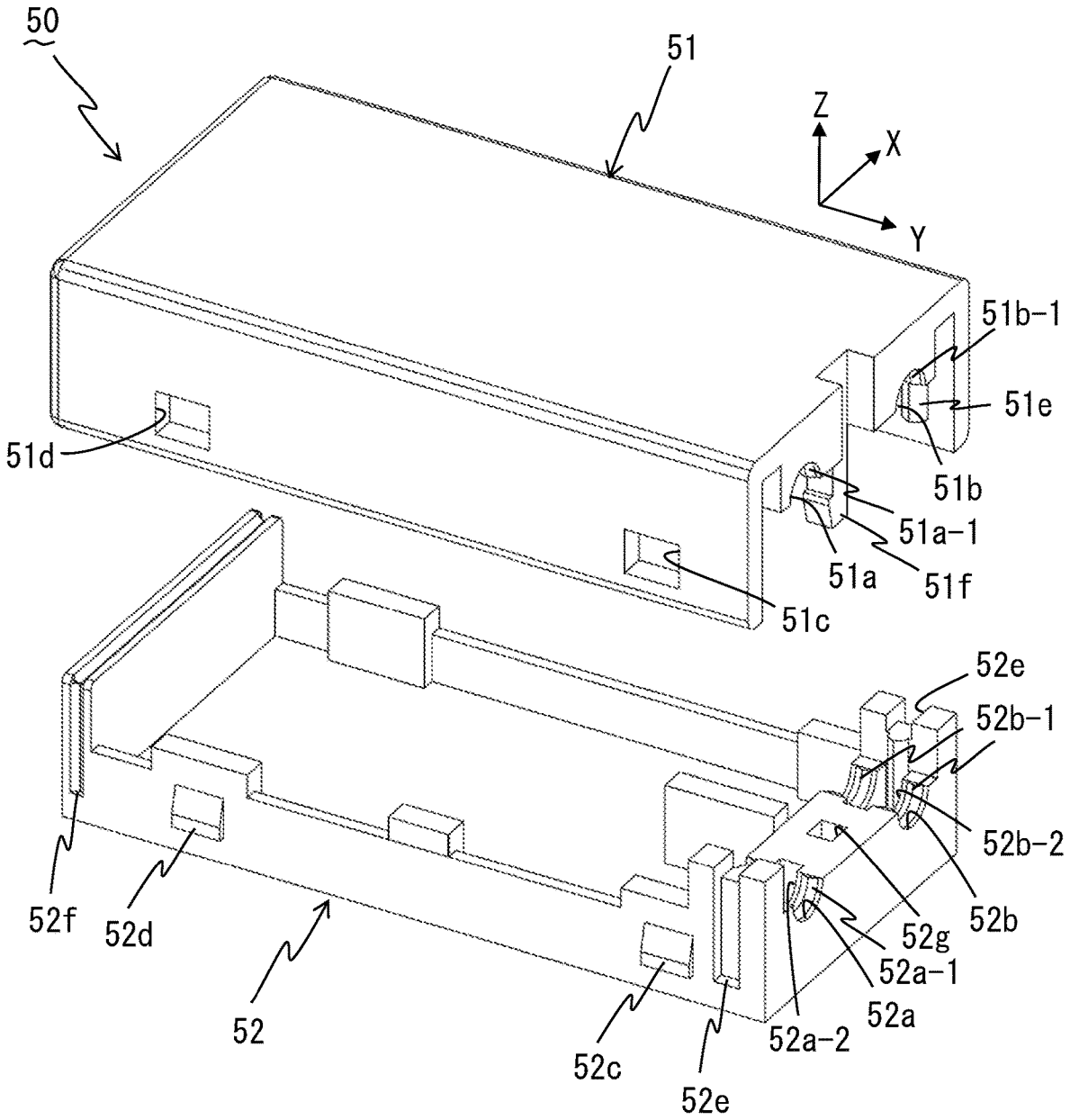
FIG. 7 is an exploded perspective view illustrating a temperature-switch insulation case according to the fifth embodiment.

FIG. 7 is an exploded perspective view illustrating a temperature-switch insulation case 50 according to the fifth embodiment. The insulation case 50 according to the fifth embodiment may be similar to the insulation cases 10, 20, 30, and 40 according to the first through fourth embodiments except that a first-insulation-case member 51 includes a second lock mechanism between a first-lead-wire concave portion 51*a* and a second-lead-wire concave portion 51*b* and that a second-insulation-case member 52 includes a second lock mechanism between a first-lead-wire concave portion 52*a* and a second-lead-wire concave portion 52*b*. Accordingly, constituents in FIG. 7 that are similar to those denoted by the numbers between 30 and 39 in FIG. 5 are denoted by the numbers between 50 and 59 in such a manner that the constituents similar in FIG. 5 and FIG. 7 have the same ones place digits, and their explanations will be omitted.

Examples of the second lock mechanisms may include an internal-lock click 51*f* for the first-insulation-case member 51 and an internal-lock opening 52*g* for the second-insulation-case member 52. Note that the second lock mechanism is not limited to a configuration having a click such as the internal-lock click 51*f*, but may employ a different configuration such as for example one using a member for achieving interference-fit. It is desirable that the internal-lock click 51*f* and the internal-lock opening 52*g* be in the middle in the arrangement directions (X directions) of the first and second lead wires 5 and 6 in the insulation case 50. The internal-lock click 51*f* projects downward (Z direction) from the first-insulation-case member 51 and has its tip portion projecting in one of the arrangement directions of the first and second lead wires 5 and 6 (X directions) illustrated in FIG. 1 and FIG. 2, similarly to external-lock clicks 52*c* and 52*d* constituting the first lock mechanism. In other words, the internal-lock click 51*f* achieves locking in a direction parallel to the locking directions of the external-lock clicks 52*c* and 52*d*. Note that the internal-lock opening 52*g* not only extends vertically, but also has a space to accommodate the projecting tip portion of the internal-lock click 51*f*. Also, the internal-lock opening 52*g* is provided in such a manner that the internal-lock opening 52*g* for example pierces the second-insulation-case member 52 vertically (Z directions) in order to facilitate molding.

The fifth embodiment enables the internal-lock click 51*f* and the internal-lock opening 52*g*, which are examples of second lock mechanisms, to more surely suppress repelling forces near the portions in which these repelling forces are generated, the repelling forces being generated by the compression of the covering members 5*a* and 6*a* of the first and second lead wires 5 and 6. This can achieve an effect that the first and second lead wires 5 and 6 can be held further surely, in addition to the effects of the first through fourth embodiments.

Sixth Embodiment

Figure 8:
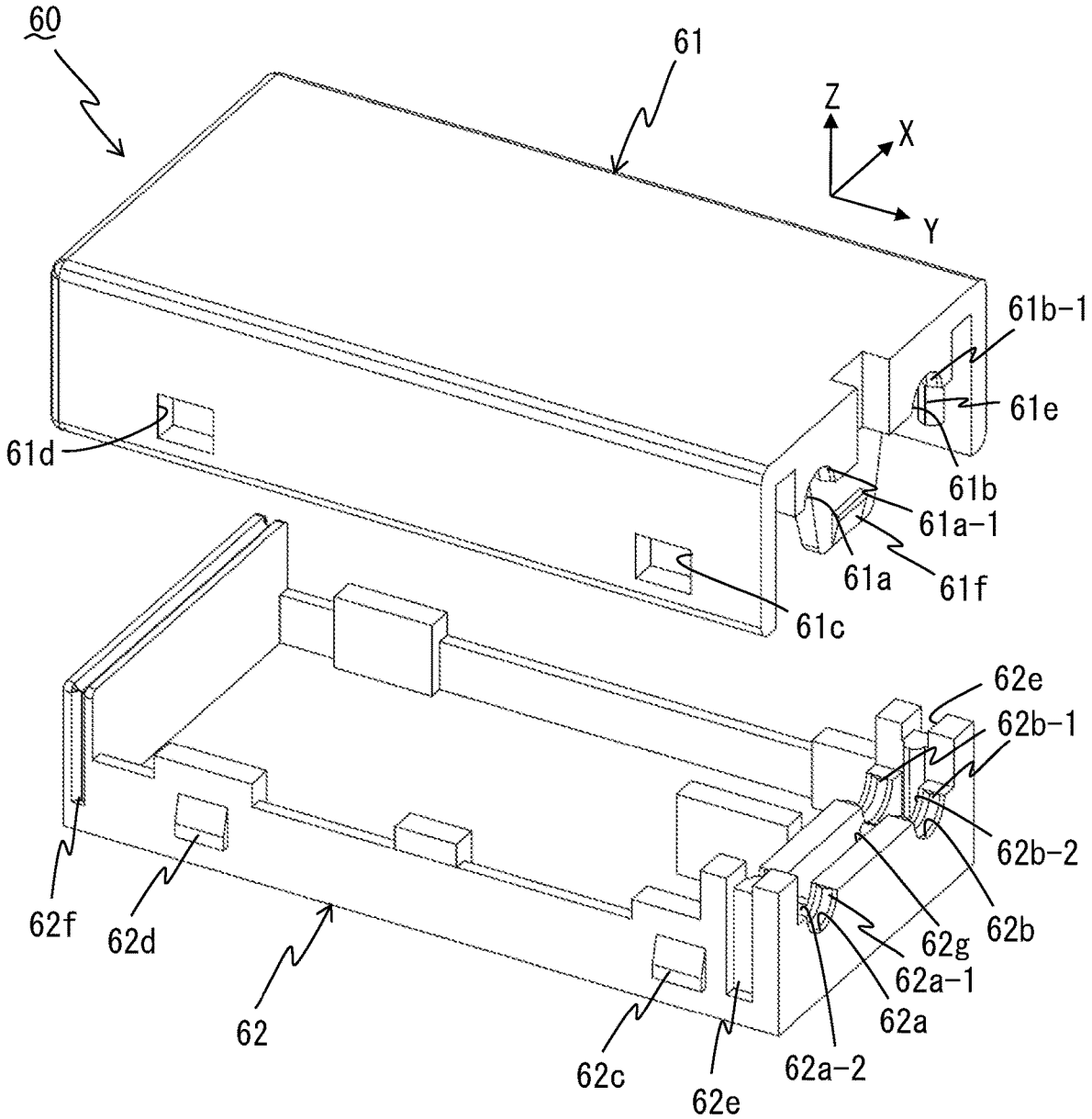
FIG. 8 is an exploded perspective view illustrating a temperature-switch insulation case according to the sixth embodiment.

FIG. 8 is an exploded perspective view illustrating a temperature-switch insulation case 60 according to the sixth embodiment. The insulation case 60 according to the sixth embodiment has an internal-lock click 61*f* and an internal-lock opening 62*g* that achieve locking in the directions orthogonal (Y directions), instead of parallel, to the locking directions (X directions) of external-lock openings 61*c* and 61*d* and external-lock clicks 62*c* and 62*d* as examples of first lock mechanisms, the internal-lock click 61*f* and the internal-lock opening 62*g* being examples of second lock mechanisms. In other words, the internal-lock click 61*f* projects downward (Z direction) from the first-insulation-case member 61 and has its tip portion in one of the axial directions (Y directions) of the first and second lead wires 5 and 6. Except this, the insulation case 60 according to the sixth embodiment may be similar to the insulation cases 10, 20, 30, 40, and 50 according to the first through fifth embodiments. Accordingly, constituents in FIG. 8 that are similar to those denoted by the numbers between 50 and 59 in FIG. 7 are denoted by the numbers between 60 and 69 in such a manner that the constituents similar in FIG. 7 and FIG. 8 have the same ones place digits, and their explanations will be omitted.

According to the sixth embodiment, the internal-lock click 61*f* and the internal-lock opening 62*g* cooperate with the external-lock openings 61*c* and 61*d* and the external-lock clicks 62*c* and 62*d*, have the locking directions orthogonal to each other, and thereby can further surely suppress repelling forces caused by the compression of the covering members 5*a* and 6*a* of the first and second lead wires 5 and 6 and also can ensure the symmetry of the insulation case 60 in the arrangement directions (X directions) of the first and second lead wires 5 and 6. This can achieve an effect that the first and second lead wires 5 and 6 can be held further surely, in addition to the effects of the first through fifth embodiments.

While the first through sixth embodiments of the present invention have been explained above, the present invention is included in the scope of the inventions described in the claims and their equivalents. Below, the inventions described in the original claims of the present application as filed are added as appendixes.

APPENDIXES

Appendix 1. A temperature switch comprising:

a temperature detection unit configured to detect a temperature so as to move a movable contact to a position that is in contact with a fixed contact and to a position that is separated from the fixed contact;

a first lead wire that is connected to the fixed contact and that includes a covering member;

a second lead wire that is connected to the movable contact and that includes a covering member; and a first-insulation-case member and a second-insulation-case member each of which includes a first-lead-wire concave portion and a second-lead-wire concave portion, and which are fit into each other so as to form an accommodation space that accommodates the temperature detection unit, the movable contact, and the fixed contact, where the first-lead-wire concave portion accepts insertion of the covering member of the first lead wire and the second-lead-wire concave portion accepts insertion of the covering member of the second lead wire.

Appendix 2. The temperature switch according to appendix 1, wherein a plurality of ribs that project at positions apart in axial directions of the first lead wire are formed on the first-lead-wire concave portions, a plurality of ribs that project at positions apart in axial directions of the second lead wire are formed on the second-lead-wire concave portions, the plurality of ribs of the first-lead-wire concave portion of the first-insulation-case member and the plurality of ribs of the first-lead-wire concave portion of the second-insulation-case member come into contact with each other so as to tighten the covering member of the first lead wire all along circumference of the covering member of the first lead wire, and the plurality of ribs of the second-lead-wire concave portion of the first-insulation-case member and the plurality of ribs of the second-lead-wire concave portion of the second-insulation-case member come into contact with each other so as to tighten the covering member of the second lead wire all along circumference of the covering member of the second lead wire.

Appendix 3. The temperature switch according to appendix 2, wherein the first-lead-wire concave portion and the second-lead-wire concave portion of at least one of the first-insulation-case member and the second-insulation-case member include an indentation between the plurality of ribs.

Appendix 4. The temperature switch according to appendix 1, wherein the first-lead-wire concave portions and the second-lead-wire concave portions extend in axial directions of the first lead wire and the second lead wire parallel to each other, and are arranged in opposed directions of the first-lead-wire concave portion and the second-lead-wire concave portion of the first-insulation-case member and the first-lead-wire concave portion and the second-lead-wire concave portion of the second-insulation-case member and in arrangement directions orthogonal to the axial directions, each of the first-insulation-case member and the second-insulation-case member further includes a pair of first lock mechanisms that are positioned on faces on both sides sandwiching the accommodation space in the arrangement directions and that are for locking the first-insulation-case member and the second-insulation-case member, the first-lead-wire concave portion and the second-lead-wire concave portion are parallel to the axial direction of the first lead wire and the second lead wire, and the pair of the first lock mechanisms intersect a plane that contains midpoints of the first-lead-wire concave portion and the second-lead-wire concave portion in the axial directions and that is orthogonal to the axial directions.

Appendix 5. The temperature switch according to appendix 1, wherein each of the first-insulation-case member and the second-insulation-case member further includes a second lock mechanism that is positioned between the first-lead-wire concave portion and the second-lead-wire concave portion and that is for locking the first-insulation-case member and the second-insulation-case member.

Appendix 6. The temperature switch according to appendix 5, wherein the first-lead-wire concave portions and the second-lead-wire concave portions extend in axial directions of the first lead wire and the second lead wire parallel to each other, and are arranged in opposed directions of the first-lead-wire concave portion and the second-lead-wire concave portion of the first-insulation-case member and the first-lead-wire concave portion and the second-lead-wire concave portion of the second-insulation-case member and in arrangement directions orthogonal to the axial directions, each of the first-insulation-case member and the second-insulation-case member further includes a pair of first lock mechanisms that are positioned on faces on both sides sandwiching the accommodation space in the arrangement directions and that are for locking the first-insulation-case member and the second-insulation-case member, and the second lock mechanisms lock the first-insulation-case member and the second-insulation-case member in directions that are orthogonal to directions in which the pair of the first lock mechanisms lock the first-insulation-case member and the second-insulation-case member.

Appendix 7. A temperature-switch insulation case arranged in a temperature switch that includes a temperature detection unit configured to detect a temperature so as to move a movable contact to a position that is in contact with a fixed contact and to a position that is separated from the fixed contact, the temperature-switch insulation case comprising:

a first-insulation-case member and a second-insulation-case member each of which includes a first-lead-wire concave portion and a second-lead-wire concave portion, and which are fit into each other, where the first-lead-wire concave portion accepts insertion of a covering member of a first lead wire that is connected to the fixed contact and that includes the covering member and the second-lead-wire concave portion accepts insertion of a covering member of a second lead wire that is connected to the movable contact and that includes the covering member.

SYMBOLS

| | |
|---|---|
| 1 | TEMPERATURE SWITCH |
| 2 | MOVABLE CONTACT |
| 3 | FIXED CONTACT |
| 4 | TEMPERATURE DETECTION UNIT |
| 4a | BIMETAL |
| 4b | MOVABLE PLATE |
| 5 | FIRST LEAD WIRE |
| 5a | COVERING MEMBER |
| 6 | SECOND LEAD WIRE |
| 6a | COVERING MEMBER |
| 10, 20, 30, 40, 50, 60 | INSULATION CASE |
| 11, 21, 31, 41, 51, 61 | FIRST-INSULATION-CASE MEMBER |
| 12, 22, 32, 42, 52, 62 | SECOND-INSULATION-CASE MEMBER |
| 11a, 12a, 21a, 22a, 31a, 32a, 41a, 42a, 51a, 52a, 61a, 62a | FIRST-LEAD-WIRE CONCAVE PORTION |
| 11b, 12b, 21b, 22b, 31b, 32b, 41b, 42b, 51b, 52b, 61b, 62b | SECOND-LEAD-WIRE CONCAVE PORTION |
| 11a-1, 11b-1, 12a-1, 12b-1 | CHAMFERED PORTION |
| 21a-1, 21b-1, 22a-1, 22b-1, 31a-1, 31b-1, 32a-1, 32b-1, 41a-1, 41b-1, 42a-1, 42b-1, 51a-1, 51b-1, 52a-1, 52b-1, 61a-1, 61b-1, 62a-1, 62b-1 | RIB |
| 32a-2, 32b-2, 42a-2, 42b-2, 52a-2, 52b-2, 62a-2, 62b-2 | INDENTATION |
| 11c, 11d, 21c, 21d, 31c, 31d, 41c, 41d, 51c, 51d, 61c, 61d | EXTERNAL-LOCK OPENING |
| 12c, 12d, 22c, 22d, 32c, 32d, 42c, 42d, 52c, 52d, 62c, 62d | EXTERNAL-LOCK CLICK |
| 11e, 21e, 31e, 41e, 51e, 61e | NEAR-SIDE CONVEX PORTION |
| 12e, 22e, 32e, 42e, 52e, 62e | NEAR-SIDE GROOVE |
| 12f, 22f, 32f, 42f, 52f, 62f | FAR-SIDE GROOVE |
| 51f, 61f | INTERNAL-LOCK CLICK |
| 52g, 62g | INTERNAL-LOCK OPENING |
| S | ACCOMMODATION SPACE |
| X | ARRANGEMENT DIRECTIONS OF FIRST LEAD WIRE AND SECOND LEAD WIRE |
| Y | AXIAL DIRECTIONS OF FIRST LEAD WIRE AND SECOND LEAD WIRE |
| Z | OPPOSED DIRECTIONS OF FIRST-LEAD-WIRE CONCAVE PORTION AND SECOND-LEAD-WIRE CONCAVE PORTION |

What is claimed is:

1. A temperature switch comprising:

a temperature detection unit configured to detect a temperature so as to move a movable contact to a position that is in contact with a fixed contact and to a position that is separated from the fixed contact;

a first lead wire that is connected to the fixed contact and that includes a covering member;

a second lead wire that is connected to the movable contact and that includes a covering member; and a first-insulation-case member and a second-insulation-case member each of which includes a first-lead-wire concave portion and a second-lead-wire concave portion, and which are fit into each other so as to form an accommodation space that accommodates the temperature detection unit, the movable contact, and the fixed contact, where the first-lead-wire concave portion accepts insertion of the covering member of the first lead wire and the second-lead-wire concave portion accepts insertion of the covering member of the second lead wire, wherein each of the first-insulation-case member and the second-insulation-case member further includes a second lock mechanism that is positioned between the first-lead-wire concave portions and the second-lead-wire concave portions of the first-insulation-case member and the second-insulation-case member and that is for locking the first-insulation-case member and the second-insulation-case member, the second lock mechanism includes an internal-lock click of the first-insulation-case member and an internal-lock opening of the second-insulation-case member, the first-lead-wire concave portions and the second-lead-wire concave portions extend in axial directions of the first lead wire and the second lead wire parallel to each other, and are arranged in opposed directions of the first-lead-wire concave portion and the second-lead-wire concave portion of the first-insulation-case member and the first-lead-wire concave portion and the second-lead-wire concave portion of the second-insulation-case member and in arrangement directions orthogonal to the axial directions, each of the first-insulation-case member and the second-insulation-case member further includes at least one pair of first lock mechanisms that are positioned on faces on both sides of each of the first-insulation-case member and the second-insulation-case member sandwiching the accommodation space in the arrangement directions and that are for locking the first-insulation-case member and the second-insulation-case member, the at least one pair of first lock mechanisms includes an external-lock opening of the first-insulation-case member and an external-lock click of the second-insulation-case member, and the second lock mechanism locks the first-insulation-case member and the second-insulation-case member in directions that are orthogonal to directions in which the at least one pair of first lock mechanisms locks the first-insulation-case member and the second-insulation-case member.

2. The temperature switch according to claim 1, wherein:

a plurality of ribs that project at positions apart in the axial direction of the first lead wire are formed on the first-lead-wire concave portions, a plurality of ribs that project at positions apart in the axial direction of the second lead wire are formed on the second-lead-wire concave portions, the plurality of ribs of the first-lead-wire concave portion of the first-insulation-case member and the plurality of ribs of the first-lead-wire concave portion of the second-insulation-case member come into contact with each other so as to tighten the covering member of the first lead wire all along a circumference of the covering member of the first lead wire, and the plurality of ribs of the second-lead-wire concave portion of the first-insulation-case member and the plurality of ribs of the second-lead-wire concave portion of the second-insulation-case member come into contact with each other so as to tighten the covering member of the second lead wire all along a circumference of the covering member of the second lead wire.

3. The temperature switch according to claim 2, wherein:

the first-lead-wire concave portion and the second-lead-wire concave portion of at least one of the first-insulation-case member and the second-insulation-case member include an indentation between the plurality of ribs.

4. A temperature-switch insulation case arranged in a temperature switch that includes a temperature detection unit configured to detect a temperature so as to move a movable contact to a position that is in contact with a fixed contact and to a position that is separated from the fixed contact, the temperature-switch insulation case comprising:

a first-insulation-case member and a second-insulation-case member each of which includes a first-lead-wire concave portion and a second-lead-wire concave portion, and which are fit into each other so as to form an accommodation space that accommodates the temperature detection unit, the movable contact, and the fixed contact, where the first-lead-wire concave portion accepts insertion of a covering member of a first lead wire that is connected to the fixed contact and that includes the covering member and the second-lead-wire concave portion accepts insertion of a covering member of a second lead wire that is connected to the movable contact and that includes the covering member, wherein each of the first-insulation-case member and the second-insulation-case member further includes a second lock mechanism that is positioned between the first-lead-wire concave portions and the second-lead-wire concave portions of the first-insulation-case member and the second-insulation-case member and that is for locking the first-insulation-case member and the second-insulation-case member, the second lock mechanism includes an internal-lock click of the first-insulation-case member and an internal-lock opening of the second-insulation-case member, the first-lead-wire concave portions and the second-lead-wire concave portions extend in axial directions of the first lead wire and the second lead wire parallel to each other, and are arranged in opposed directions of the first-lead-wire concave portion and the second-lead-wire concave portion of the first-insulation-case member and the first-lead-wire concave portion and the second-lead-wire concave portion of the second-insulation-case member and in arrangement directions orthogonal to the axial directions, each of the first-insulation-case member and the second-insulation-case member further includes at least one pair of first lock mechanisms that are positioned on faces on both sides of each of the first-insulation-case member and the second-insulation-case member sandwiching the accommodation space in the arrangement directions and that are for locking the first-insulation-case member and the second-insulation-case member, the at least one pair of first lock mechanisms includes an external-lock opening of the first-insulation-case member and an external-lock click of the second-insulation-case member, and the second lock mechanism locks the first-insulation-case member and the second-insulation-case member in directions that are orthogonal to directions in which the at least one pair of first lock mechanisms locks the first-insulation-case member and the second-insulation-case member.

* * * * *